US007246648B2

(12) United States Patent
Minder

(10) Patent No.: US 7,246,648 B2
(45) Date of Patent: Jul. 24, 2007

(54) FRICTION DEVICE FOR ROLLING UP CURTAINS AND THE LIKE

(75) Inventor: Carl Emil Felix Minder, Milan (IT)

(73) Assignee: Silent Gliss Italia S.r.l., Milan (IT)

( * ) Notice: Subject to any disclaimer, the term of this patent is extended or adjusted under 35 U.S.C. 154(b) by 0 days.

(21) Appl. No.: 10/550,988

(22) PCT Filed: Mar. 24, 2004

(86) PCT No.: PCT/IB2004/001050

§ 371 (c)(1),
(2), (4) Date: Sep. 26, 2005

(87) PCT Pub. No.: WO2004/085786

PCT Pub. Date: Oct. 7, 2004

(65) Prior Publication Data

US 2006/0219371 A1 Oct. 5, 2006

(30) Foreign Application Priority Data

Mar. 28, 2003 (IT) ..... BO2003A0174

(51) Int. Cl.
*E06B 9/56* (2006.01)

(52) U.S. Cl. ..... 160/296; 160/8

(58) Field of Classification Search ..... 160/296, 160/298, 307, 317, 8
See application file for complete search history.

(56) References Cited

U.S. PATENT DOCUMENTS 700,951 A * 5/1902 Leach ..... 160/292
1,783,002 A * 11/1930 Simpson ..... 160/299
5,437,324 A * 8/1995 Sternquist ..... 160/299
6,123,140 A * 9/2000 Bergamaschi ..... 160/316
6,530,717 B1 * 3/2003 Bergamaschi ..... 403/325
6,955,207 B2 * 10/2005 Minder ..... 160/298

FOREIGN PATENT DOCUMENTS

| | | |
|---|---|---|
| DE | 3614415 | 11/1987 |
| EP | 0909868 | 10/1998 |
| FR | 2476735 | 8/1981 |
| FR | 2673236 | 8/1992 |

* cited by examiner

*Primary Examiner*—David Purol
(74) *Attorney, Agent, or Firm*—William J. Sapone; Coleman Sudol Sapone P.C.

(57) ABSTRACT

A friction device for rolling up curtains and the like includes a tubular roller (1), on which a curtain (1*a*) is wound. The roller (1) is rotatably carried by a support (10) and a threaded stem (2) is situated axially inside the roller (1) and carries, mounted thereon by a screw coupling, an operative body (3), likewise situated inside the roller (1). The operative body (3) translates axially with respect to the threaded stem (2) during motion of the curtain (1*a*) from a rolled up configuration (A) to a unrolled configuration (B). Elastic blocks (41, 51) push on the operating body (3) to produce a friction effect on the operating body and transmitted to roller (1) during curtain (1*a*) transition between the unrolled and rolled up configurations, thus allowing operation of the curtain in a substantially balanced way during rolling up and/or unrolling. Stop nuts (40, 50) are fastened to the threaded stem (2) for compressing the elastic blocks against surfaces of the operating body (3).

18 Claims, 2 Drawing Sheets

FRICTION DEVICE FOR ROLLING UP CURTAINS AND THE LIKE

CROSS REFERENCE TO RELATED APPLICATIONS

This application is the national stage of international application PCT/IB2004/001050 filed Mar. 24, 2004.

BACKGROUND OF THE INVENTION

The present invention relates to production of rolling up curtains, aimed at being applied to windows and the like for darkening and/or protection and/or decoration.

DESCRIPTION OF THE PRIOR ART

These curtains are usually rolled up on a substantially horizontal roller, supported, with possibility to rotate, inside a suitable case situated above the window. The axial rotation of the roller makes the curtain unroll or roll up.

Usually, according to a widespread embodiment, the rolling up curtains are operated manually to unroll and to roll up.

For this purpose,-a grooved pulley is situated at one end of the roller, on which the curtain is wound.

A driving chain engages with the groove made in the pulley.

The major disadvantage of the rolling up curtains results from the curtain extreme unbalancing, compensated for by the operator, during the unrolling and rolling up steps.

In fact, it can be easily understood that during the rolling up, it is necessary to pull the chain with a strength, in order to overcome the curtain weight force, while, during the unrolling, it is necessary to counterbalance the free dropping of the curtain, whose speed increases rapidly during unrolling, just to avoid too quick fall.

This disadvantage is particularly accentuated; when the curtain is relatively heavy and big.

According to another embodiment of prior art, the rolling up curtains have reinforcement means including elastic means, which are situated inside the roller, to which they are fastened, and which facilitate the curtain rolling up.

By acting directly on the curtain, the roll is made to rotate and consequently, the elastic means are twisted, so that the corresponding elastic reaction can be used for rolling up the curtain.

The elastic means are advantageously fastened at one end to the roller, and at the other end to the stationary support structure, so that the latter are stressed sufficiently to unroll the curtain.

In order to avoid any curling of the elastic means, they are usually fastened, at one end, to an element, which translate axially inside the roller and they are driven to rotate by the roller.

For example, the document EP 0.900.314 discloses improved elastic means, which supply a gradual elastic reaction during the curtain rolling up, including a plurality of helical springs, which are aimed at rolling up the curtain on a relative roller.

The helical springs are fastened to a common support, which is keyed onto a shaft, as well as to respective support and fastening elements, and which is shape-coupled to the above roller.

However, reinforcement means according to prior art, usually act as an additional contrast to the free drop of the curtain during the unrolling step, but they cannot avoid a possible fall of the curtain.

SUMMARY OF THE INVENTION

The object of the present invention is to avoid the above mentioned disadvantages by proposing a friction device for rolling up curtains and the like, which allows best balancing thereof during their rolling up and unrolling, ensuring high stability in any intermediate position.

Another object of the present invention is to propose a friction device, which allows operation of the rolling up curtains by a substantially equilibrated action during the rolling up and unrolling, independently from the curtain type and dimensions.

A further object of the present invention is to propose a particularly functional and reliable friction device, which is obtained by a technical solution of extremely simple construction, and which is particularly noiseless during its operation.

A further object of the present invention is to propose a friction device, which allows a rapid-and best adjustment of the curtains stop points, during rolling up as well as unrolling, and which is particularly simple and rapid to be assembled, and allows easy maintenance operations.

A still further object of the present invention is to propose a friction device which can be assembled in one block, and which can make easier the assembling, from which the complete curtain assembly is obtained.

The above mentioned objects are achieved by the features of the independent claim, according to which a friction device for rolling up curtains and the like, includes:

a tubular roller, on which a curtain is wound;

support means for rotatably supporting said roller;

a threaded stem supported inside said roller in a way as to create an angular displacement of said roller with respect to said threaded stem during rotation of said roller;

the device being characterized in that it further includes:

an operative body, situated slidingly inside the roller and screw-fitted onto said stem, said operative body being linked to said roller in relation to rotation so as to move axially along said threaded stem during the rotation of the roller due to unrolling and rolling up of said curtain from a rolled up configuration to a unrolled configuration and vice-versa;

first elastic means and second elastic means acting on said operating body and in opposition to one another, so as to produce a variable friction effect on said operating body during motion of said curtain between said unrolled configuration and rolled up configuration, and vice-versa, such that the curtain can be driven in a substantially balanced way during rolling up and/or unrolling;

first stop means and second stop means fastened to said threaded stem, and aimed at pressing respectively said first elastic means and second elastic means, against corresponding first surface and second surface of said operating body.

Preferred features of the invention are then defined in the dependent claims.

BRIEF DESCRIPTION OF THE DRAWINGS

The invention will now be described, by way of example, with reference to the accompanying drawings, in which.

BEST MODES OF CARRYING OUT THE INVENTION

Figure 2:
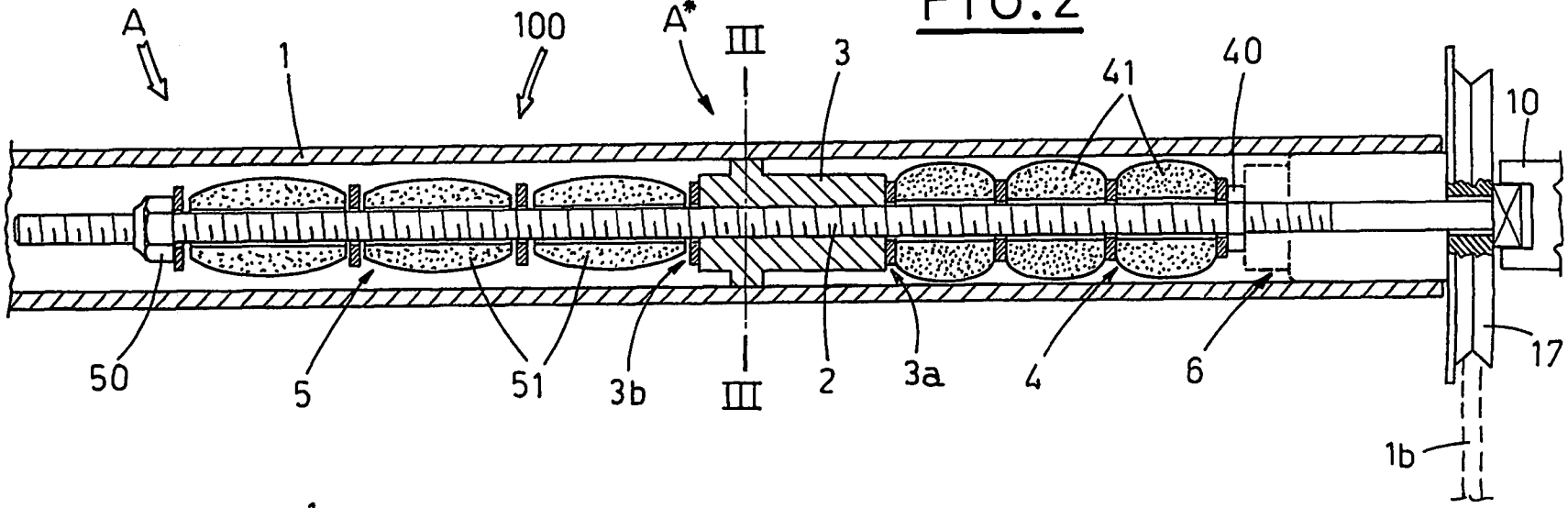
FIG. 2 is a schematic, longitudinal section view of the roller, on which is rolled up the curtain in said rolled up configuration A.

With reference to the above figures, the general reference numeral 1 indicates a tubular roller, on which a curtain la winds, and which is rotatably supported about a horizontal axis by relative support means 10, made in a stationary fixed structure.

Figure 1:
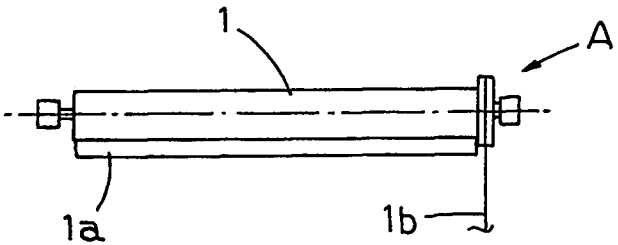
FIG. 1 is a schematic, front view of a rolling up curtain, operated by a chain, in a rolled up configuration A.
Figure 4:
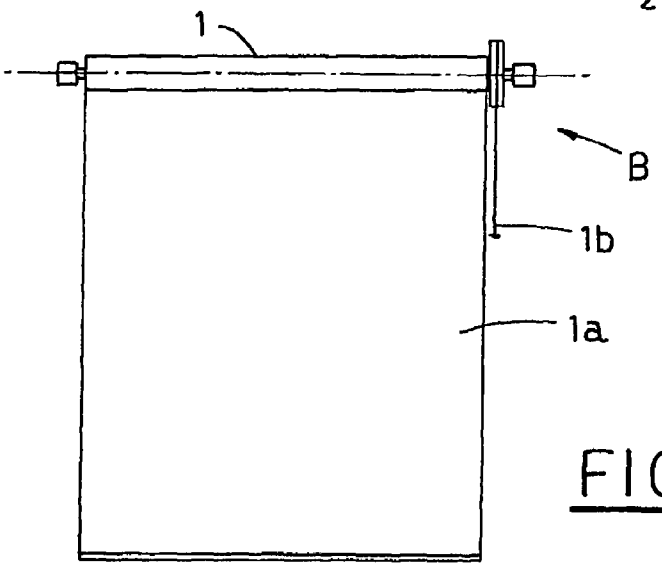
FIG. 4 is a schematic, front view of the rolling up curtain shown in FIG. 1, in unrolled configuration B.

The roller 1 is driven into rotation by a driving chain 1*b*, which engages with a shaped matching groove of a pulley 17, situated beside the roller 1. By means of the pulley, the curtain can be moved between extreme configurations, a rolled up configuration A and an unrolled configuration B (FIGS. 1, 4).

The proposed friction device, indicated as a whole with the general reference numeral 100, includes also a threaded stem 2, which is arranged axially inside the roller 1 and supported in a way as to create an angular displacement of the roller with respect to the threaded stem during rotation of the roller.

According to a preferred embodiment, the means 100 support rotatably the roller 1 and the threaded stem 2 in a stationary condition.

An operative body 3 is mounted, sliding axially within the roller and screw-coupled onto the threaded stem 2.

Figure 3:
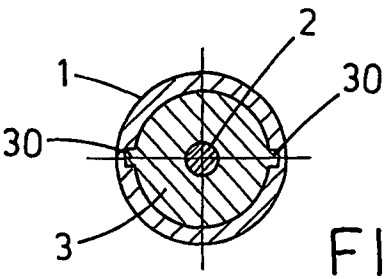
FIG. 3 is a schematic, cross section view, taken along the plane III-III of the winding roller of FIG. 2.

The operative body 3 is preferably cylindrical and can translate axially with respect to the threaded stem 2, in that it has means for prismatic coupling with the roller 1, for example, a pair of teeth 30, made in diametrically opposite positions and guided in relative inner grooves made in the roller 1 (FIG. 3).

Moreover, the friction device 100 includes elastic means, first 4 and second 5, acting on the cylindrical body 3, ones against the others, and having a friction effect on the roller 1, during the curtain 1 movement between the extreme configurations, the unrolled configuration B and rolled up configuration A, thus allowing operation of the curtain in a substantially balanced way during rolling up and/or unrolling steps.

Suitable stop means, first 40 and second 50, fastened-to the threaded stem 2, are aimed at pressing the respective elastic means, first 4 and second 5, against corresponding surfaces, first 3*a* and second 3*b*, defined by the cylindrical body 3.

The stop means 40, 50 include respective nuts screwed to the threaded stem 2 in adjustable configurations.

Figure 5:
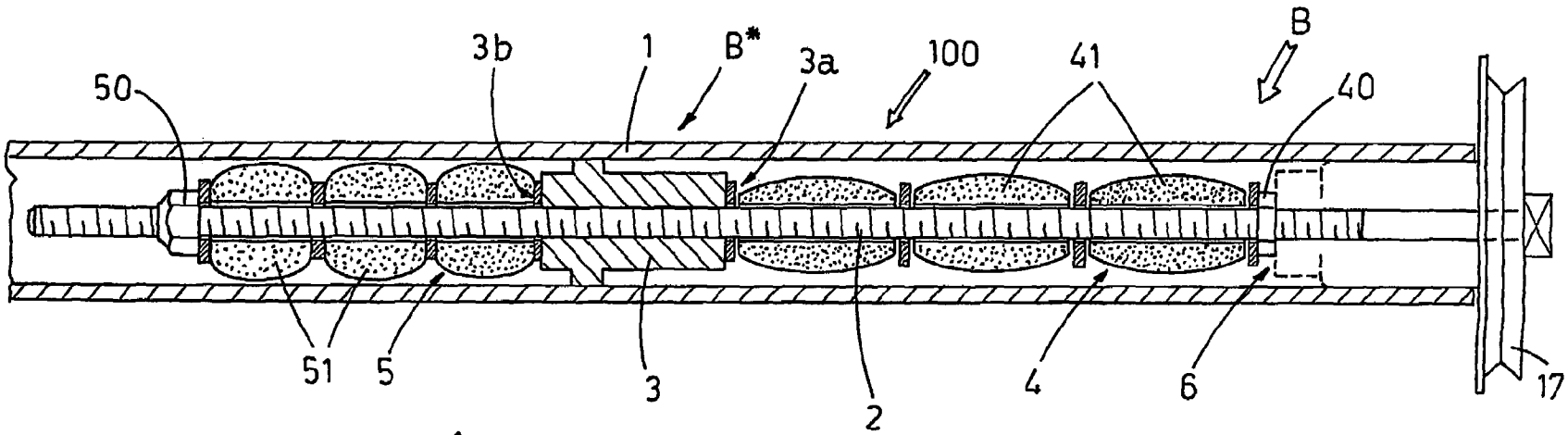
FIG. 5 is a schematic, longitudinal section view of the roller, on which is rolled up the curtain in said unrolled configuration B.

With reference to FIGS. 2 and 5, it is possible to notice that, when in the rolled up configuration A, the elastic means, first 4 and second 5, are partially compressed, that is "pre-loaded", and partially released; while, when in the unrolled configuration B, the elastic means, first 4 and second 5, are respectively partially released, and partially compressed, that is "loaded".

As it will be explained better later on, the proposed friction device 100, allows easily to define the upper A* stop point and the lower stop point B*, of the curtain 1*a*, in relation to the maximum compression of elastic means, respectively first 4 and second 5.

In particular, the stop points, upper A* and lower B*, can be adjusted in relation to the adjustment of the nuts 40, 50, as well as in relation to the nature and/or dimensions of the elastic means 4, 5.

In this case, the maximum compression is intended as the maximum compression that can be applied without making the operation chain 1*b* slide inside the shaped groove of the pulley 17.

According to a preferred embodiment, the elastic means, first 4 and second 5, include respective series of elements, a first series 41 and a second series 51, of resilient material, fitted freely on the threaded stem 2, close to one another.

The resilient elements 41, 51 can be either spheroid, or ellipsoid blocks of resilient material, having a through hole along a diametrical axis and fitted freely on the threaded stem 2, close to one another.

The resilient material, of which the pluralities of elements 41, 51 are made, can be neoprene gum or any other kind of synthetic or natural gum.

The operation principle of the friction device 100 proposed by the invention, will be briefly described in the following, beginning from a rolled up configuration A of the curtain la (FIG. 1).

With reference to FIG. 2, it can be noted that in the rolled up configuration A, the first resilient elements 41, comprised between the first surface 3*a* of the cylindrical body 3 and the first nut 40, are partially compressed, in other words, they are pre-loaded in a predetermined way; while the second resilient elements 51, comprised between the second surface 3*b* of the cylindrical body 3 and the second nut 50, are partially released.

By acting suitably on the driving chain 1*b*, which engages with the shaped groove of the pulley 17, the curtain 1*a* is moved from the rolled up configuration A to the unrolled configuration B (FIGS. 1, 4), setting the roller 1 into rotation with respect to the support means 10.

Due to the action of the pair of opposite teeth 30 made in the cylindrical body 3, the movement of the roller 1 drives also the cylindrical body 3 into rotation.

Contemporarily, the cylindrical body 3 translates axially with respect to the threaded stem 2, with which it is screw coupled.

During the curtain transition from rolled up configuration A to the unrolled configuration B, the cylindrical body 3 translates with respect to the threaded stem 2, moving away from the first nut 40, that is moving closer to the second nut 50.

During the translation towards the second nut 50, the cylindrical body 3 is subjected to the friction action generated by the gradual release of the first elastic means 41, which have a fixed stop on the first nut 40, as well as to the friction action caused by gradual compression of the second elastic means 51, which have a fixed stop on the second nut 50.

Thus, the resistance action applied by the resulting friction acting on the cylindrical body 3, compensates for the weight effect of the curtain 1*a*, which constantly increases during unrolling, until the unrolled configuration B is reached (FIG. 4).

With reference to FIG. 5, it is to be noted that in the unrolled configuration B, the first resilient elements 41, previously "pre-loaded", are now partially released, while the second elastic means 51, previously released, are now partially compressed, that is they are under a predetermined "load".

The compression of the second elastic means 51, which have a fixed stop on the second nut 50, facilitates the subsequent transition of the curtain 1*a* from the unrolled configuration B to the rolled up configuration A, contrasting the weight effect of the curtain 1*a,* which decreases continuously during the rolling up, until the rolled up configuration A is reached (FIG. 1).

During the transition of the curtain 1*a* from the unrolled configuration B to the rolled up configuration A, the cylindrical body 3 translates with respect to the threaded stem 2, moving far from the second nut 50, that is moving close to the first nut 40.

During the translation close to the first nut 40, the cylindrical body 3 is subjected to the friction action generated by the gradual release of the second elastic means 51, as well as to the friction action caused by the gradual compression of the first resilient elements 41.

Consequently, during the unrolling of the curtain 1*a,* the second elastic means 51 are gradually compressed and the first resilient elements 41 are gradually released, which results in a friction action, balancing the weight effect of the curtain 1*a,* which increases continuously, until the unrolled configuration B is reached.

On the contrary, during the rolling up of the curtain la, the first resilient elements 41 are gradually compressed and the second elastic means 51 are gradually released, which results in a friction action, balancing the weight effect of the curtain 1*a*, which decreases continuously, until the rolled up configuration A is reached.

What above, can be likewise applied to the case, in which the curtain 1*a* is moved between the corresponding stop points, upper A* and lower B* respectively.

In this case, by changing suitably the setting of the nuts 40, 50 and/or by suitable action during assemblage on the nature and/or dimensions of the plurality of resilient elements 41, 51, it is possible to adjust the stop points, upper A* and lower B* respectively.

Advantageously, the upper stop points A* of the curtain la is defined at a point corresponding to the maximum compression of the first resilient elements 41, while the lower stop points B* is defined at a point corresponding to the maximum compression of the second resilient elements 51.

As it has been anticipated, maximum compression means the maximum compression, which can be applied without making the operation chain 1*b* slide within the shaped groove of the pulley 17.

Thus, it is no doubt clear that the stop points A*, B* of the curtain 1*a* can be easily adjusted by acting on the setting of the nuts 40, 50.

According to interesting embodiments, the resilient elements 41, 51 of the relevant pluralities can have each one different diameters and/or different compression characteristics, due to the fact that they are made of resilient material of different hardness.

The resilient elements 41, 51 can also have a peripheral facing, which avoid interference with the inner surface of the roller 1, inside which they are housed.

It is understood that the number of the resilient elements 41, 51 of the plurality is variable and is a direct function of the dimensions, thus weight, of the rolling up curtain 1*a*.

In practice, what above allows to fit properly to a wide range of situations.

According to another embodiment, a reduction group 6 (indicated with a broken line in FIGS. 2 and 5) is aimed at driving the threaded stem 2 into rotation with respect to the roller 1, by angular displacements reduced with respect to the latter, during the curtain 1*a* movement.

Consequently, the proposed friction device for rolling up curtains and the like ensures best balancing thereof during their rolling up and unrolling, ensuring high stability in any intermediate position.

Therefore, it allows to operate rolling up curtains and the like by a substantially equilibrated action during the rolling up as well as unrolling, independently from the curtain type and dimensions.

The strength of the materials and duration in time of the characteristics of the elastic means, ensures high standards and reliability of the proposed friction device, as well as extreme noiselessness during any operation step.

Moreover, the proposed friction device ensures a best adjustment of the curtains stop points, during the curtain rolling up as well as unrolling, thus allowing simple and rapid assembling, as well as easy maintenance operations.

The possibility to adjust the curtain stop points by acting on the setting of the, stop means and/or by acting during assemblage on the nature and/or dimensions of the pluralities of the resilient elements allows undeniable advantages.

Consequently, the proposed device not only does fulfill all the objects of the present invention, but it is also cheap in relation to the obtained results, structurally simple, reliable and functional as well.

The invention claimed is:

1. A friction device for rolling up curtains comprising:

a tubular roller (1), for winding and unwinding a curtain (1*a*) between a rolled up configuration (A), in which the curtain (1*a*) is wound on the roller (1), and an unrolled configuration (B), in which the curtain (1*a*) is unwound from the roller (1);

support means (10) for rotatably supporting said roller (1);

a threaded stem (2) supported inside said roller (1) disposed for angularly displacing said roller with respect to said threaded stem during rotation of said roller;

first stop means (40) fastened to a part of said stem (2) and second stop means (50) fastened to a second part of said stem (2);

an operative body (3), slidingly movable inside the roller (1) and fitted onto said stem (2) between said first stop means and said second stop means, said operative body (3) being engaged to and driven by said roller (2) so as to move axially along said threaded stem (2) during rotation of the roller during the unrolling and rolling up of said curtain (1*a*);

first elastic means (4) interposed between said first stop means (40) and a first surface (3*a*) of said operative body (3), and second elastic means (5) interposed between said second stop means (50) and a second surface (3*b*) of the operative body (3), wherein, in a rolled up configuration (A), the operative body (3) is positioned in respect to the stem (2) such that said first elastic means (4) are at least partially compressed and said second elastic means (5) are at least partially released, while in an unrolled configuration (B), the operative body (3) is positioned in respect to the stem (2) such that said first elastic means (4) are at least partially released and second elastic means (5) are at least partially compressed, said operative body (3), during rotation of the roller (1) for unrolling of the curtain (1*a*) from the rolled up configuration (A) to the unrolled configuration (B), being moved axially along the stem (2) close to said second stop means (50) so that second elastic means (51) are gradually compressed and said first elastic means (41)

are gradually released and, during rotation of the roller (1) for rolling up of the curtain (1*a*) from the unrolled configuration (B) to the rolled up configuration (A), being moved axially along the stem (2) close to said first stop means (4) so that the first elastic means (41) are gradually compressed and second elastic means (51) are gradually released.

2. The device according to claim 1 further comprising at least one upper stop point (A*) of said curtain (1*a*) defined at a point where said first elastic means (4) reaches a level of compression where said operative body is prevented from moving further towards said first elastic means.

3. The device according to claim 2 further comprising at least one lower stop point (B*) of said curtain (1*a*) defined at a point where said second elastic means (5) reaches a level of compression where said operative body is prevented from moving further towards said second elastic means.

4. The device according to claim 3 wherein said upper stop point (A*) and said lower stop point (B*) are adjustable in relation to said first stop means (40) and said second stop means (50).

5. The device according to claim 4 wherein said upper stop point (A*) and said lower stop point (B*) are adjustable in relation to defined characteristics of said first elastic means (4) and said second elastic means (5).

6. The device according to claim 1 wherein said threaded stem (2) is supported in a stationary position by said support means (10) which allow said roller (1) to rotate with respect to the threaded stem (2) during unrolling and rolling up of said curtain (1*a*).

7. The device according to claim 1 further comprising a speed reduction group (6) for driving said threaded stem (2) into rotation with respect to said roller (1), by angular displacement, the speed of the stem reduced with respect to the speed of the roller, during unrolling and rolling up of the curtain (1*a*).

8. The device according to claim 1 wherein said operative body (3) is a cylinder having a first surface (3*a*) and a second surface (3*b*), the cylinder having means for coupling with the roller (1).

9. The device according to claim 8 wherein said means for coupling include at least one tooth (30) located on said cylinder (3), the tooth guided in a corresponding inner longitudinal groove located in the roller (1).

10. The device according to claim 8 wherein said means for coupling include a pair of diametrically opposed teeth located on said cylinder (3), the pair of teeth guided in corresponding inner longitudinal grooves located in the roller (1).

11. The device according to claim 1 wherein said first stop means (40) and said second stop means (50) include nuts screwed to said threaded stem (2).

12. The device according to claim 1 wherein said first elastic means (4) and said second elastic means (5) are made of a resilient material.

13. The device according to claim 12 wherein said first elastic means (41) and said second elastic means (51) each have a spheroid shape and have holes along a diametrical axis, through which said threaded stem (2) passes.

14. The device according to claim 12 wherein said first elastic means (41) and said second elastic means (51) are ellipsoid blocks having holes along a diametrical axis, through which said threaded stem (2) passes.

15. The device according to claim 12 wherein said resilient material is selected from the group consisting of neoprene gum, a synthetic resilient material, and a natural resilient material.

16. The device, according to claim 12 wherein said first elastic means (41) and said second elastic means (51) have different compression characteristics relative to each other.

17. The device according to claim 1 wherein said first elastic means (41) and said second elastic means (51) have peripheral facings which avoid contact with an inner surface of the roller (1).

18. The device according to claim 1 wherein said first elastic means (41) and said second elastic means (51) have different diameters relative to each other.

* * * * *